US010939705B2

(12) United States Patent
Kuwa et al.

(10) Patent No.: US 10,939,705 B2
(45) Date of Patent: Mar. 9, 2021

(54) PORTABLE AEROSOL DEVICES AND METHODS THEREOF

(71) Applicant: TMA LABS LLC, Los Angeles, CA (US)

(72) Inventors: Tomiei Kuwa, Tokyo (JP); Mark Hoashi, Los Angeles, CA (US); Vardan Kushkyan, Valley Village, CA (US); Gayk Mikaelyan, Panorama City, CA (US)

(73) Assignee: TMA Labs LLC, Los Angeles, CA (US)

( * ) Notice: Subject to any disclaimer, the term of this patent is extended or adjusted under 35 U.S.C. 154(b) by 246 days.

(21) Appl. No.: 16/011,463

(22) Filed: Jun. 18, 2018

(65) Prior Publication Data

US 2018/0360119 A1 Dec. 20, 2018

Related U.S. Application Data

(60) Provisional application No. 62/522,031, filed on Jun. 19, 2017.

(51) Int. Cl.

| | |
|---|---|
| ***A24D 1/14*** | (2006.01) |
| ***A24F 40/44*** | (2020.01) |
| ***A24F 47/00*** | (2020.01) |
| ***A24F 7/00*** | (2006.01) |
| ***H05B 1/02*** | (2006.01) |
| *H05B 3/02* | (2006.01) |

(52) U.S. Cl.

CPC ..... *A24F 47/008* (2013.01); *A24D 1/14* (2013.01); *A24F 7/00* (2013.01); *H05B 1/0227* (2013.01); *A24F 40/44* (2020.01); *H05B 3/02* (2013.01)

(58) Field of Classification Search

CPC ..... A24F 47/008; A24D 1/14
USPC ..... 131/329
See application file for complete search history.

(56) References Cited

U.S. PATENT DOCUMENTS

| | | | | |
|---|---|---|---|---|
| 5,564,442 | A * | 10/1996 | MacDonald | A24F 13/00 131/194 |
| 5,842,297 | A * | 12/1998 | Tung | G02B 6/0038 40/546 |
| 6,598,607 | B2 * | 7/2003 | Adiga | A24F 47/004 131/194 |
| 8,157,919 | B2 * | 4/2012 | Vazales | A61B 1/0669 134/8 |

(Continued)

OTHER PUBLICATIONS

PCT/US2018/038363 filed Jun. 19, 2018 International Search Report and Written Opinion dated Sep. 20, 2018.

*Primary Examiner* — Eric Yaary
*Assistant Examiner* — Russell E Sparks
(74) *Attorney, Agent, or Firm* — Levine Bagade Han LLP

(57) ABSTRACT

Provided herein is a portable aerosol device including, in some embodiments, a mouthpiece, a cartridge, and a shell configured for inserting the cartridge into the shell. Regarding the cartridge, the cartridge can include a tank configured to hold a vaporizable material, a wick and a heating element for vaporizing the material, an air path to the wick and the heating element, an aerosol path from the wick and the heating element, and a battery configured to power the portable aerosol device. The air and aerosol paths can be at least partially positioned in a space between the tank and the battery. Regarding the shell, the shell can include an air intake hole, a viewing window, a closed end, and an insertion opening.

25 Claims, 8 Drawing Sheets

(56) References Cited

U.S. PATENT DOCUMENTS

Figure 1A:
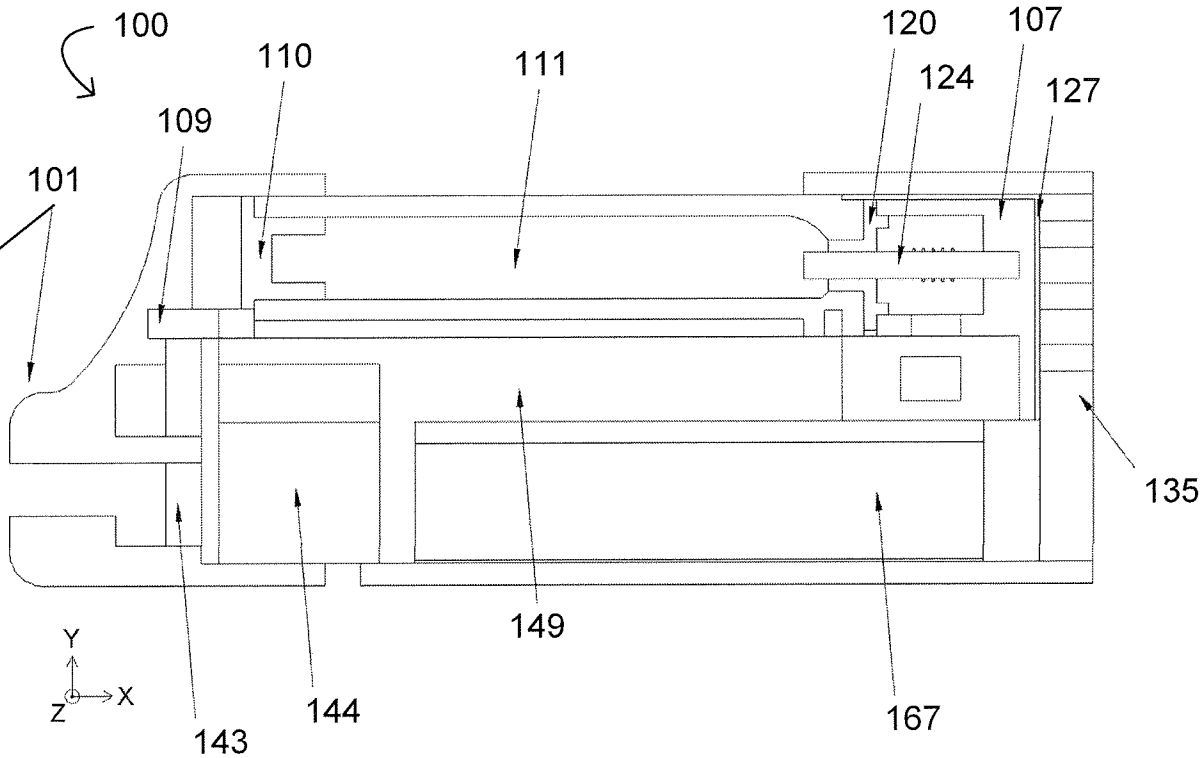

| | | | | |
|---|---|---|---|---|
| 8,707,965 | B2 | 4/2014 | Newton | |
| 9,132,248 | B2 * | 9/2015 | Qiu | A61M 11/041 |
| 9,907,339 | B2 * | 3/2018 | Liu | H05B 1/0244 |
| 9,913,493 | B2 * | 3/2018 | Worm | A61M 15/06 |
| 10,076,139 | B2 * | 9/2018 | Monsees | H05B 3/44 |
| 2011/0265806 | A1 | 11/2011 | Alarcon et al. | |
| 2011/0277756 | A1 | 11/2011 | Terry et al. | |
| 2013/0192615 | A1 | 8/2013 | Tucker et al. | |
| 2014/0123989 | A1 | 5/2014 | LaMothe | |
| 2015/0245654 | A1 | 9/2015 | Memari et al. | |
| 2015/0328415 | A1 | 11/2015 | Minskoff et al. | |
| 2016/0050975 | A1 * | 2/2016 | Worm | A61M 15/06 131/328 |
| 2016/0095357 | A1 * | 4/2016 | Burton | B23P 19/00 131/328 |
| 2016/0213066 | A1 | 7/2016 | Zitzke et al. | |
| 2016/0219938 | A1 | 8/2016 | Mamoun et al. | |
| 2017/0135398 | A1 * | 5/2017 | Scott | A61M 11/042 |
| 2017/0238613 | A1 * | 8/2017 | Suess | H05B 1/0244 |
| 2018/0160735 | A1 * | 6/2018 | Borkovec | A24F 47/008 |

* cited by examiner

PORTABLE AEROSOL DEVICES AND METHODS THEREOF

PRIORITY

This application claims the benefit of priority to U.S. Provisional Patent Application No. 62/522,031, filed Jun. 19, 2017, titled "Aerosol Device and Methods Thereof," which is hereby incorporated by reference into this application in its entirety.

FIELD

Provided herein are portable aerosol devices that create an aerosol for inhalation by heating up a vaporizable material to at least a vaporization temperature thereof. Such portable aerosol devices can be refillable or non-refillable portable aerosol devices, each of which can have a tank configured to hold the vaporizable material and feed it automatically to an element for vaporization.

BACKGROUND

There have been many aerosol-making devices that make aerosol by heating up material stored inside a tank that automatically feeds the material to a vaporization element. Electronic cigarette or "e-cig" vaporizers are the most well-known portable aerosol devices for this matter. This type of device is very advantageous since it is easy to use, very cheap, and functions fairly well. However, by principal, all of such e-cig devices have potential leakage problems. Some are better, but basically all the devices can leak. Within this category, non-refillable devices are manufactured especially simply and cheaply, so there seems to be no such device that really satisfies today's consumer needs. Consumers need cheap, durable, compact, functional, and reliable products with good designs. The cheapest type of devices are all pen-type, cigarette-like devices that feel too long to comfortably carry in one's pocket. When this type of device is made very short and compact, then the aerosol tends to get hot such that users do not feel comfortable and safe inhaling the aerosol. Furthermore, the mouthpiece is made detachable and often easily comes off unless screwed in. Moreover, these cheap type devices are not designed for full consumption of the material stored inside tank, although people would like to see the full consumption. Similarly, a good view of material stored inside tank is appreciated by consumers. Provided herein are portable aerosol devices and methods thereof that address the foregoing.

SUMMARY

Provided herein is a portable aerosol device including, in some embodiments, a mouthpiece, a cartridge, and a shell having an insertion opening configured for inserting the cartridge into the shell. With respect to the cartridge, the cartridge can include a tank configured to hold a vaporizable material, a light source configured to illuminate the tank, a vaporizing means for vaporizing the material, an air path to the vaporizing means, an aerosol path from the vaporizing means, and a battery configured to supply electricity to the portable aerosol device. The tank can include a first end, a second end, and a sidewall between the first and second ends. The light source can be configured to illuminate the tank, any material in the tank, or a combination thereof. The vaporizing means can include a wick configured to wick the material from the tank to a heating element configured to heat wicked material to at least a vaporization temperature thereof and provide an aerosol of the wicked material. The battery can be configured to supply electricity to the heating element and the light source. The air path to the vaporizing means can fluidly connect the vaporizing means to a source of external air for the vaporizing means. The aerosol path from the vaporizing means can fluidly connect the vaporizing means to the mouthpiece configured to provide the aerosol to a user of the portable aerosol device. Each path of the air and aerosol paths can be at least partially positioned in a space between the tank and the battery. With respect to the shell, the shell can include an air intake hole, a viewing window, an open or closed end, and the insertion opening.

In some embodiments, the shell can include a closed end.

In some embodiments, the portable aerosol device can further include a cover configured to cover the cartridge upon inserting the cartridge into the shell.

In some embodiments, more than 50% of a length of each path of the air and aerosol paths can be located inside the space between the tank and the battery when the cartridge is inserted into the shell.

In some embodiments, the portable aerosol device can further include a column integral with the tank disposed in the cartridge between the tank and the battery. The column can include at least a portion of the air and aerosol paths.

In some embodiments, each path of the air and aerosol paths can form an 'L' shape in the cartridge.

In some embodiments, at least one path of the air and aerosol paths can twice form an 'L' shape in the cartridge or the portable aerosol device.

In some embodiments, the tank, the battery, or each one of the tank and the battery can be approximately circular in shape in accordance with a transverse cross-section thereof. Each path of the air and aerosol paths can be configured to use unclaimed space in the portable aerosol device adjacent to the tank, the battery, or each one of the tank and the battery.

In some embodiments, at least a portion of a sidewall of the tank can be configured as an optical guide for illuminating the tank, any of the material in the tank, or a combination thereof.

In some embodiments, an inner sidewall and an outer sidewall of the tank opposite the viewing window can be flat and parallel to each other providing the optical guide, inside which light from the light source can make a total internal reflection in the sidewall.

In some embodiments, the outer, flat sidewall of the tank opposite the viewing window can be adjacent to one or more optical elements selected from a diffuser and a grating.

In some embodiments, at least a portion of the outer sidewall of the tank can be a textured surface such as a scratched surface or an otherwise roughened surface configured to act as a diffuser.

In some embodiments, the textured surface can include one or more patterns for material-level indication in the tank, indication of heating element being turned on, decoration, or a combination thereof.

In some embodiments, the wick is selected from a fiber wick, a silica wick, and ceramic wick.

In some embodiments, the wick can be a fiber wick inserted in a porous ceramic-wick tube.

In some embodiments, the wick can be a porous ceramic wick, and the heating element can be a coil at least partially embedded in an outer surface of the wick.

In some embodiments, the first end of the tank can include a tank opening configured for inserting a tank seal into the tank opening. The tank opening can be commensurate with an inner diameter of the tank.

In some embodiments, the tank opening can be configured as a threaded female connector, and the tank seal can be configured as a threaded male connector.

In some embodiments, the tank seal can be silicone, rubber, metal, plastic, or a combination thereof.

In some embodiments, the shell can include a shell injection hole in a first end of the shell proximate the first end of the tank. The tank seal can be a self-sealing silicone or rubber tank seal such that the material can be injected with a needle through both the shell injection hole and the silicone or rubber tank seal.

In some embodiments, the tank includes a tank opening at a location other than the first end of the tank.

In some embodiments, the shell can include a shell injection hole proximate the sidewall of the tank. The tank can include a sidewall hole sealed with a self-sealing silicone or rubber sidewall seal such that the material can be injected with a needle through both the shell injection hole and the silicone or rubber sidewall seal.

In some embodiments, the shell injection hole can be the viewing window of the shell.

In some embodiments, the viewing window can be positioned on only one side of the shell.

In some embodiments, the shell can include a locking mechanism configured to lock the cartridge in the shell upon inserting the cartridge into the shell and restrict longitudinal motion of the cartridge in the shell.

In some embodiments, the air intake hole can be positioned in the shell opposite the viewing window of the shell or above the coil.

In some embodiments, a transverse cross-section of the aerosol path is at least 1 $mm^2$.

In some embodiments, the light source can be positioned in the portable aerosol device proximate the first end of the tank.

In some embodiments, the light source can be positioned to project at least some light though the sidewall of the tank.

In some embodiments, the light source can be positioned to project at least some light through the first end of the tank.

In some embodiments, the sidewall of the tank can include a UV coating to protect the material in the tank from UV radiation.

In some embodiments, the sidewall of the tank includes the UV coating on an outside of the tank.

In some embodiments, the shell can include a UV-coated transparent sheet, a transparent sheet of a UV-blocking material, or a UV-coated transparent sheet of a UV-blocking material over the viewing window to protect the material in the tank from UV radiation.

In some embodiments, the sidewall of the tank can include an anti-reflective coating.

In some embodiments, the sidewall of the tank includes the anti-reflective coating on an outside of the tank.

In some embodiments, the shell can include an anti-reflective-coated transparent sheet, a transparent sheet of an anti-reflective material, or an anti-reflective-coated transparent sheet of an anti-reflective material over the viewing window to protect the material in the tank from UV radiation.

In some embodiments, the shell can have a smooth outer surface, and one end of the shell can be closed with the mouthpiece.

In some embodiments, a bottom face of the shell can be the one end of the shell that is closed.

In some embodiments, the bottom face of the shell includes vent holes.

In some embodiments, the tank can include an inner sidewall and an outer sidewall between the first and second ends of the tank, and a smooth transition from the inner sidewall to an exit hole in the second end of tank.

Also provided herein is a portable aerosol device including, in some embodiments, a mouthpiece, a cartridge, and a shell having an insertion opening configured for inserting the cartridge into the shell. With respect to the cartridge, the cartridge can include a tank configured to hold a vaporizable material, a light source configured to illuminate the tank, a vaporizing means for vaporizing the material, an air path to the vaporizing means, an aerosol path from the vaporizing means, and a battery configured to supply electricity to the portable aerosol device. The tank can include a first end, a second end, and a sidewall between the first and second ends. The tank can also include a UV coating to protect the material in the tank from UV radiation. The light source can be configured to illuminate the tank, any material in the tank, or a combination thereof. The vaporizing means can include a wick configured to wick the material from the tank to a heating element configured to heat wicked material to at least a vaporization temperature thereof and provide an aerosol of the wicked material. The battery can be configured to supply electricity to the heating element and the light source. The air path to the vaporizing means can fluidly connect the vaporizing means to a source of external air for the vaporizing means. The aerosol path from the vaporizing means can fluidly connect the vaporizing means to the mouthpiece configured to provide the aerosol to a user of the portable aerosol device. Each path of the air and aerosol paths can be at least partially positioned in a space between the tank and the battery. With respect to the shell, the shell can include an air intake hole, a viewing window, a closed end, and the insertion opening.

These and other features of the concepts provided herein will become more apparent to those of skill in the art in view of the accompanying drawings and following description, which disclose particular embodiments of such concepts in greater detail.

DRAWINGS

FIG. 1A provides a cross-sectional view of a portable aerosol device in accordance with some embodiments.

Figure 1B:
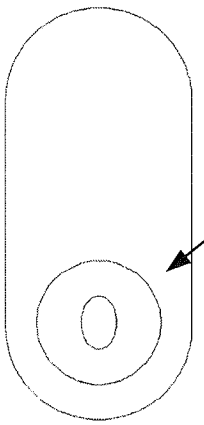

FIG. 1B provides a top view of a portable aerosol device in accordance with some embodiments.

Figure 1C:
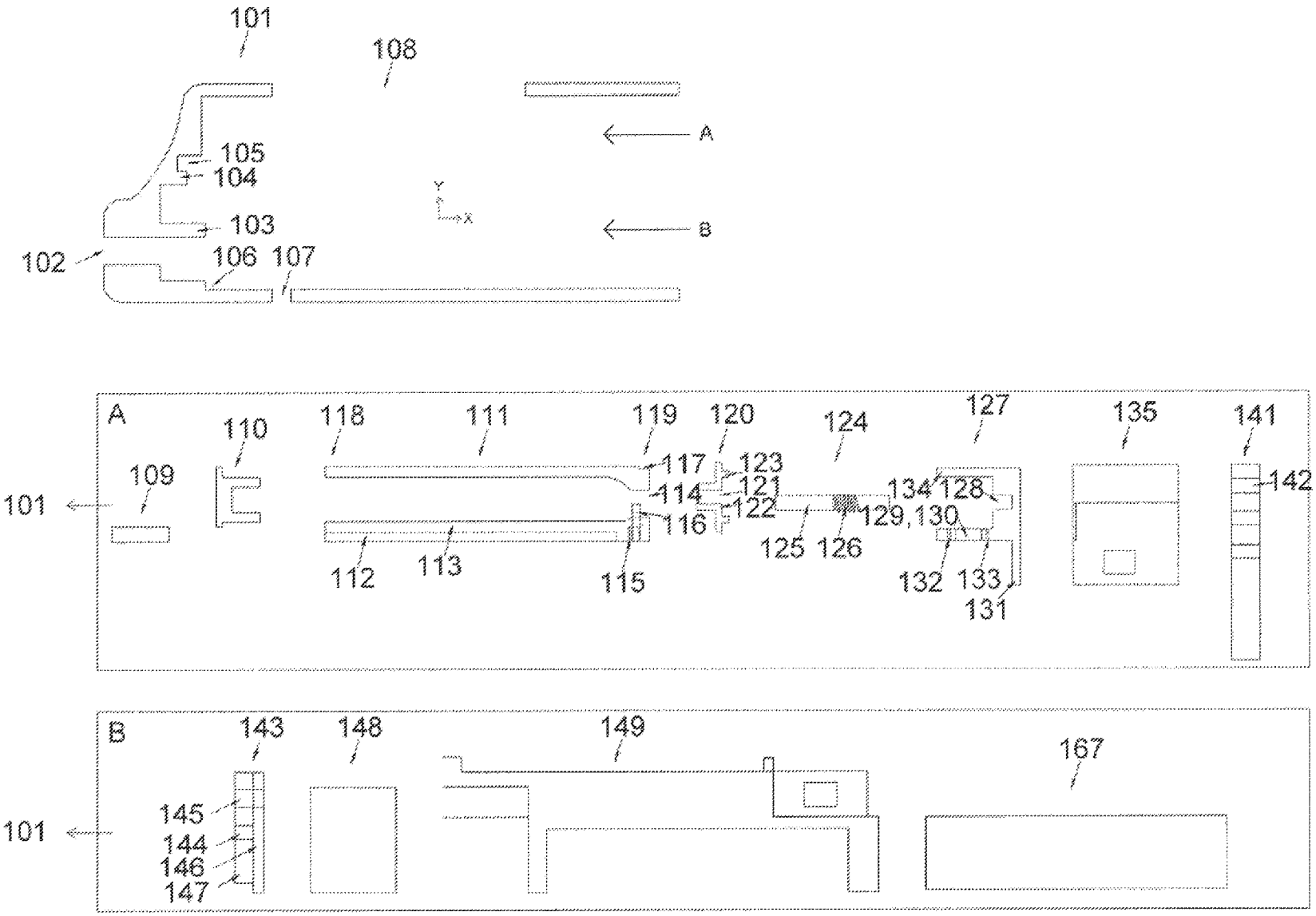

FIG. 1C provides a parts-based view of a portable aerosol device in accordance with some embodiments.

Figure 1F:
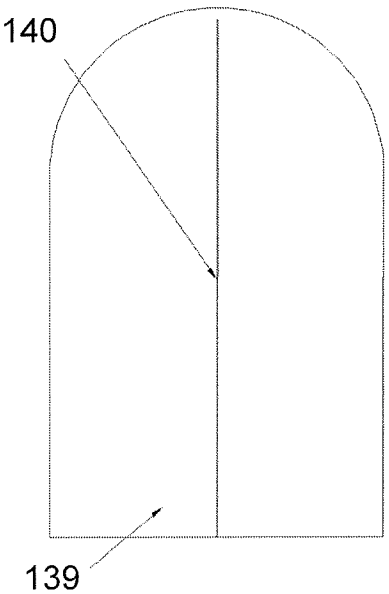
Figure 1E:
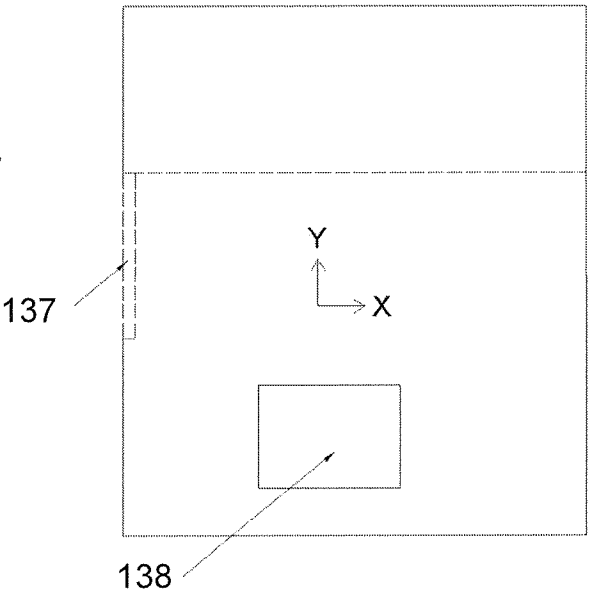
Figure 1D:
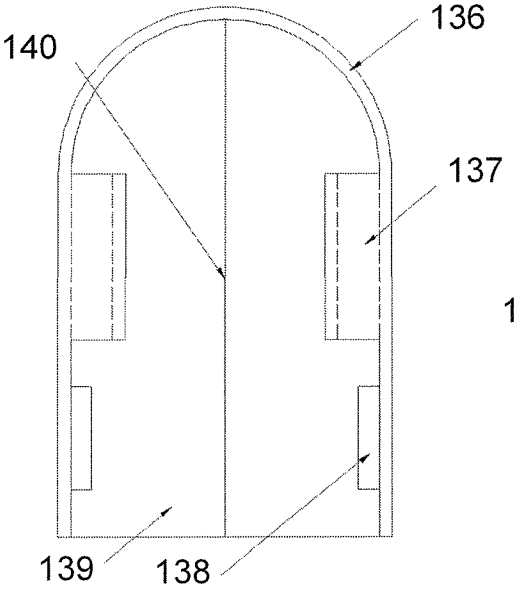

FIG. 1D provides a development view of a top of a cover in accordance with some embodiments.

FIG. 1E provides a development view of a side of a cover in accordance with some embodiments.

FIG. 1F provides a development view of a bottom of a cover in accordance with some embodiments.

Figure 1G:
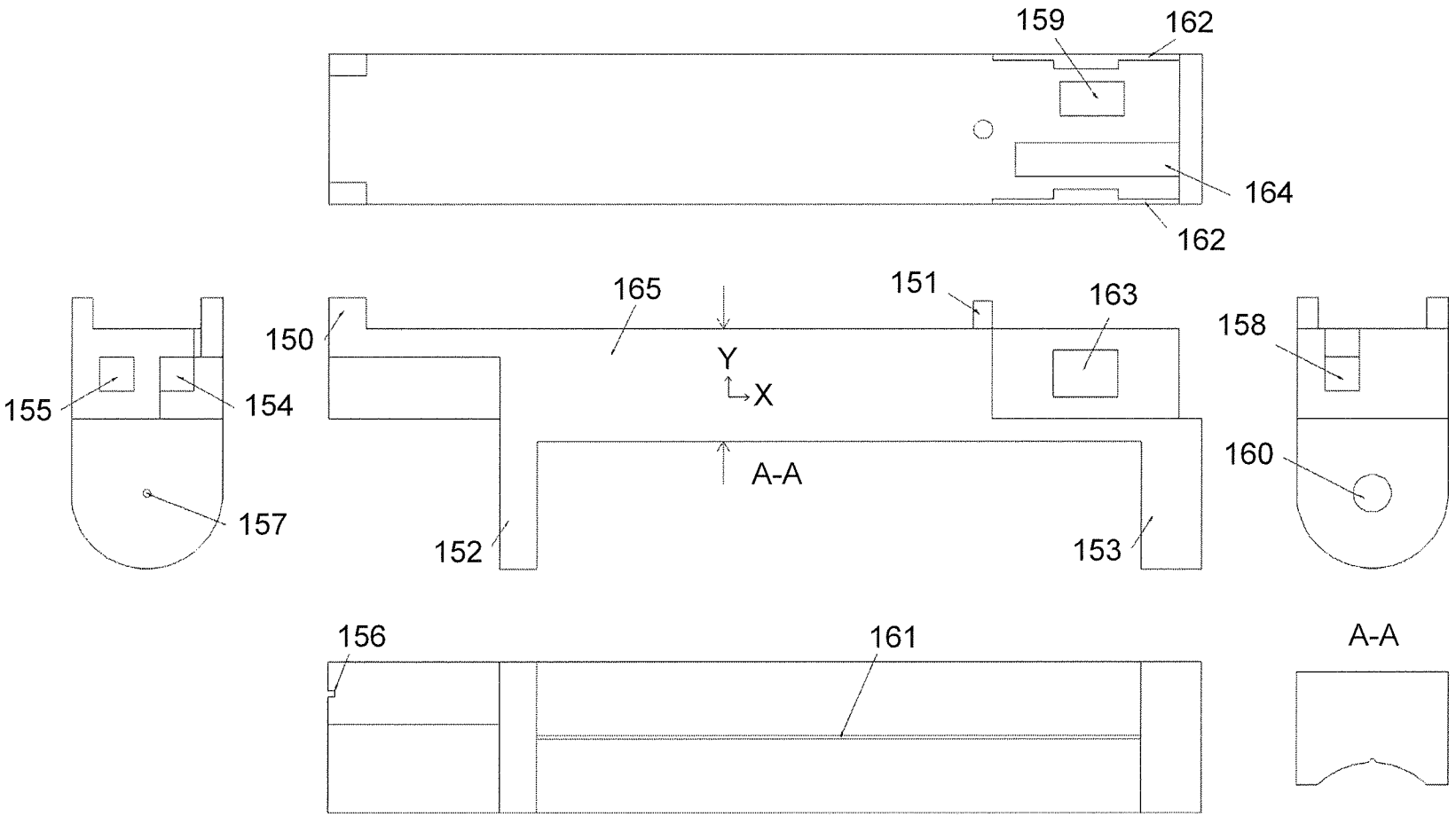

FIG. 1G provides a development view of a column in accordance with some embodiments.

Figure 2A:
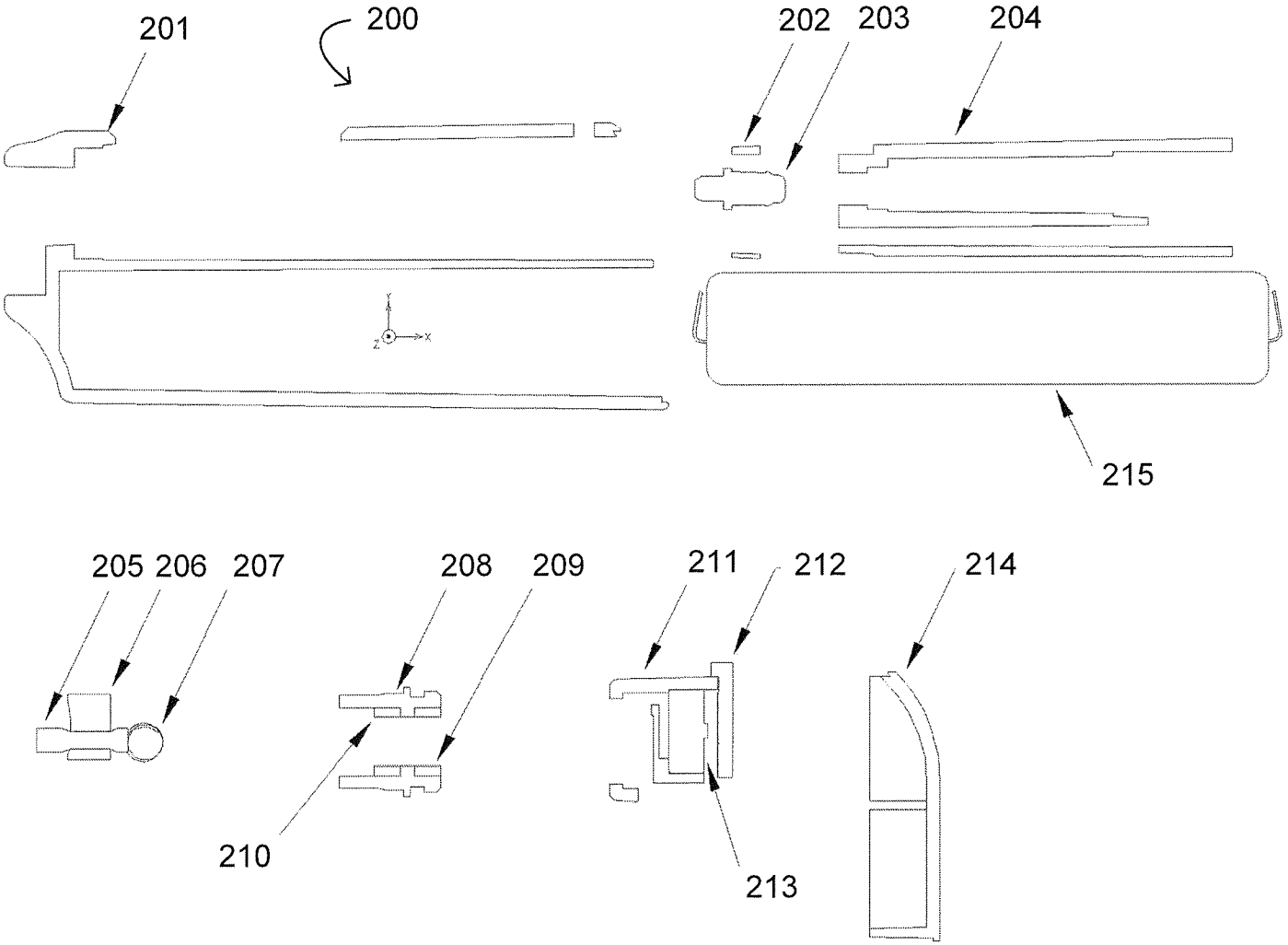

FIG. 2A provides a parts-based view of a portable aerosol device in accordance with some embodiments.

Figure 2B:
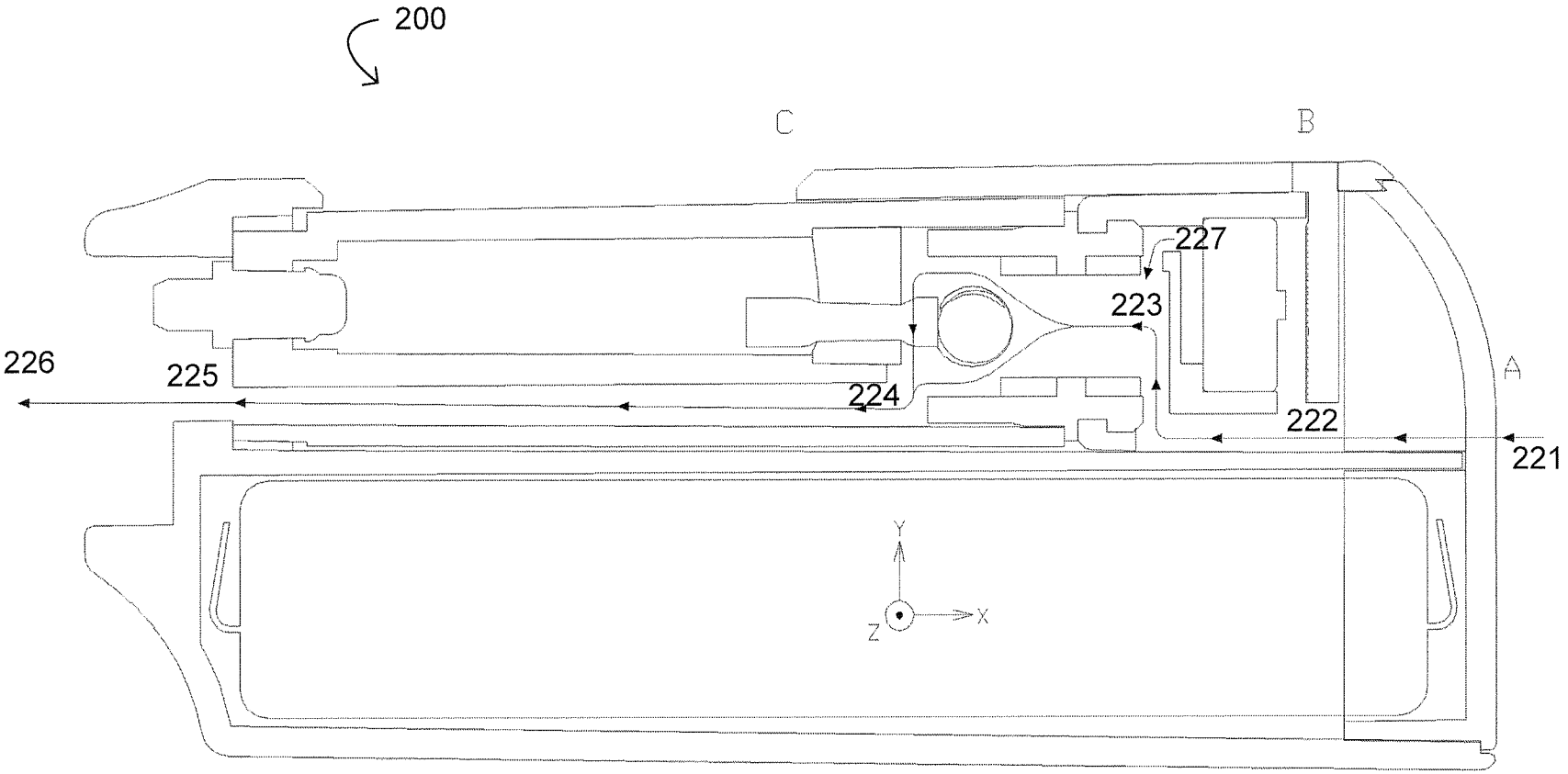

FIG. 2B provides a cross-sectional view of a portable aerosol device in accordance with some embodiments.

Figure 3A:
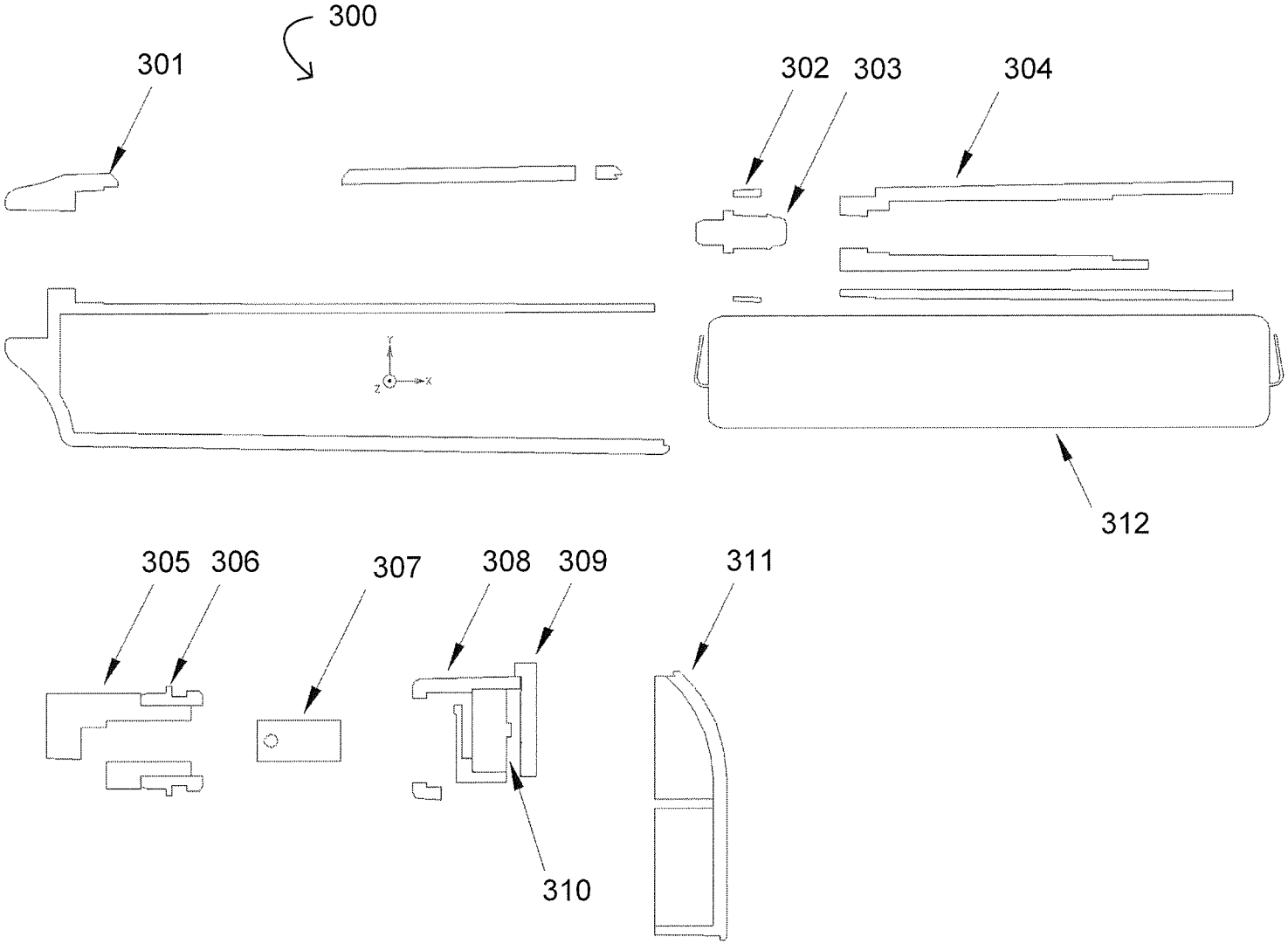

FIG. 3A provides a parts-based view of a portable aerosol device in accordance with some embodiments.

Figure 3B:
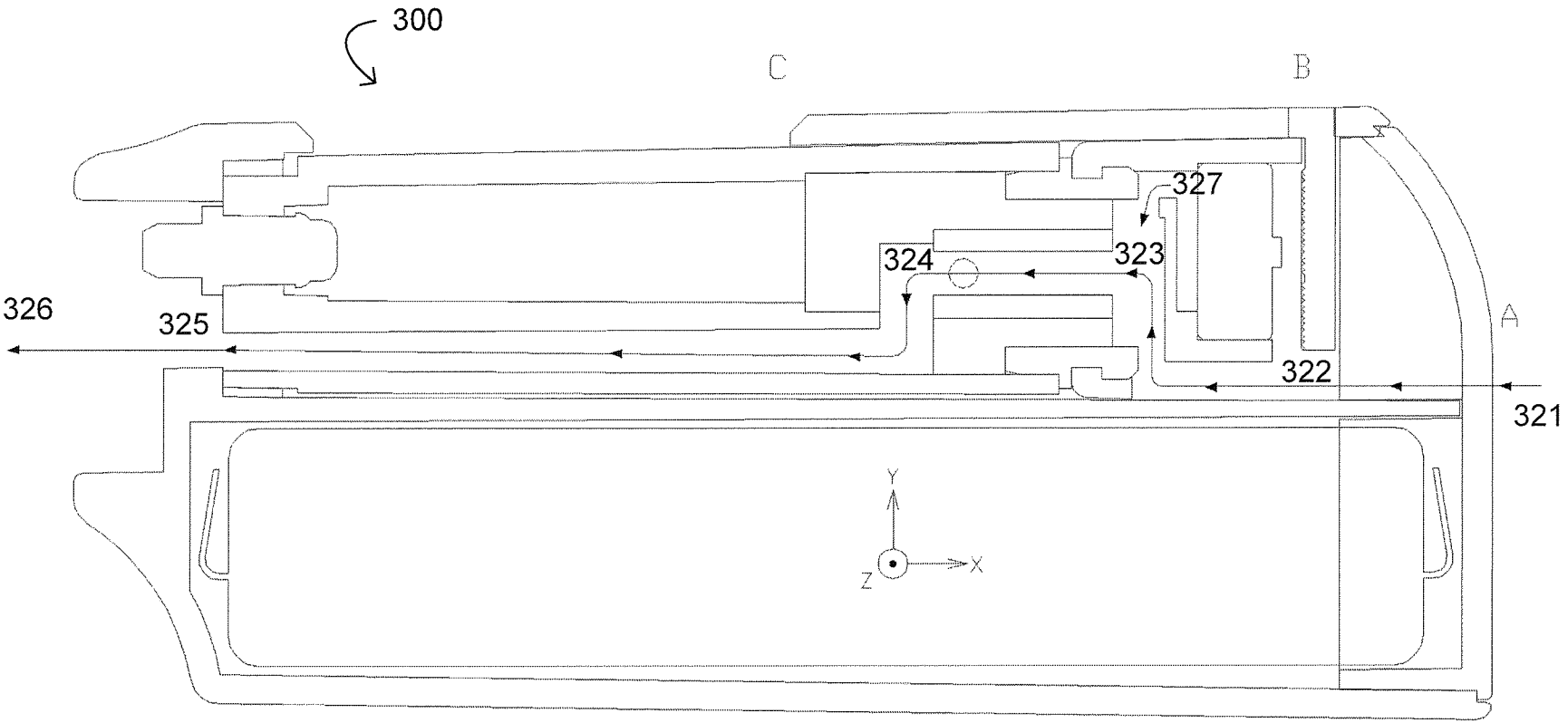

FIG. 3B provides a cross-sectional view of a portable aerosol device in accordance with some embodiments.

DESCRIPTION

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

As used herein, "air path" includes a path of air through the portable aerosol device before air gets mixed with vapor, and "aerosol path" includes a path of aerosol or vapor through the portable aerosol device after air gets mixed with the vapor. The foregoing paths can be one continuous channel through the portable aerosol device, or the paths can be two different channels through the portable aerosol device meeting at a point in the portable aerosol device where material is vaporized to form the vapor.

As used herein, each of "+x-direction," "+y-direction," and "+z-direction" is respectively used to indicate a direction toward positive x-values, a direction toward positive y-values, and a direction toward positive z-values in the Cartesian coordinate systems shown in the figures. In addition, each of "− x-direction," "− y-direction," and "− z-direction," typically with a leading en dash, is respectively used to indicate a direction toward negative x-values, a direction toward negative y-values, and a direction toward negative z-values in the Cartesian coordinate systems shown in the figures.

Unless defined otherwise, all technical and scientific terms used herein have the same meaning as commonly understood by those of ordinary skill in the art.

First Embodiment of the Portable Aerosol Device and Methods Thereof

FIGS. 1A-1G respectively provide a cross-sectional view (right) of a portable aerosol device 100, a top view (left) of the portable aerosol device, a parts-based view of portable aerosol device 100, a development view of the cover 135, and a development view of the column 149, which, together, describe a first embodiment of the portable aerosol device 100. In the following description, references made to coordinates, axes, directions, and the like utilize the right-handed Cartesian coordinate systems shown in FIGS. 1A-1G unless context indicates otherwise.

TABLE 1

Parts list for the portable aerosol device 100 of FIGS. 1A-1G.

| Part Number | Part Name |
|---|---|
| 100 | Portable aerosol device |
| 101 | Shell |
| 102 | Mouthpiece hole |
| 103 | Shell pin |
| 104 | Right shell seal step |
| 105 | Light or LED space gap |
| 106 | Peripheral shell seal step |
| 107 | Air intake hole |
| 108 | View window |
| 109 | Light or LED space |
| 110 | Top tank seal |
| 111 | Tank |
| 112 | Optical element space |
| 113 | Optical, light or LED-light guide |
| 114 | Exit hole |
| 115 | Tank joint pin hole |
| 116 | Tank grooves |
| 117 | Tank step |
| 118 | First end |
| 119 | Second end |
| 120 | Exit hole seal |
| 121 | Exit sealing hole |
| 122 | Exit sealing column |
| 123 | Exit hole seal step |
| 124 | Vaporizer unit |
| 125 | Wick |
| 126 | Coil or heating element |
| 127 | Case |
| 128 | Wick hole |
| 129 | Case air inlet |
| 130 | Case aerosol outlet |
| 131 | Case lid |
| 132 | Positive lead hole |
| 133 | Negative lead hole |
| 134 | Case wall |
| 135 | Cover |
| 136 | Cover wall |
| 137 | Cover rails |
| 138 | Cover position fixers |
| 139 | Cover bottom walls |
| 140 | Bottom face division line |
| 141 | Bottom cap |
| 142 | Vent holes |
| 143 | Top seal |
| 144 | Top seal pin hole |
| 145 | Top seal aerosol hole |
| 146 | Top seal lid |
| 147 | Top seal body |
| 148 | Chip space |
| 149 | Column |
| 150 | Column top pins |
| 151 | Column center pin |
| 152 | Column top lid |
| 153 | Column bottom lid |
| 154 | Column air inlet |
| 155 | Column aerosol outlet |
| 156 | Top wire groove |
| 157 | Top lid wire hole |
| 158 | Column air outlet |
| 159 | Column aerosol inlet |
| 160 | Bottom lid hole |
| 161 | Center wire groove |
| 162 | Column side fitting steps |
| 163 | Column fixer steps |
| 164 | Column air outlet space |
| 165 | Column body |
| 167 | Battery unit |
| A | Right-side parts |
| B | Left-side parts |

In FIG. 1C, "right side parts" A composed of one space and seven parts aligned in a common local x-axis centered at center of wick 125, and it should be aligned to A indicated on the top side of shell 101 image, and "left side parts" B composed of one space and three parts aligned in another common local x-axis centered at center of shell pin 103 and should be aligned to B indicated on the top side of shell 101 image. Detailed numbering on cover 135 and column 149 is not shown in FIG. 1C since they are done in FIGS. 1D-1G.

Top view of shell 101 is shown in FIG. 1B and x-y cross-sectional view of shell 101 is shown in FIG. 1A.

Shell 101 is made of non-transparent or transparent plastic in the first embodiment. It can be made of a silicone or rubber material, but extra plastic or metal parts may be needed in order to thinly fix "inside piece" or "cartridge," which is composed of top tank seal 110, tank 111, exit hole seal 120, vaporizer unit 124, case 127, cover 135, column 149, and battery unit 167 inside "outside piece," which is composed of shell 101, bottom cap 141, and top seal 143. Other than parts shown in FIG. 1B, inside piece also contains a PCB or other similar circuit board, an airflow sensor, a LED light, optical elements, and wires.

Air intake hole 107 is located above coil and furthermore located above a midpoint of tank volume, at the second end 119 of the tank, or in a region therebetween so that material is hard to leak out of air intake hole 107 when it is in upright orientation. Although air intake hole 107 is located near maximum material filling level in FIG. 1B, it can be located above such level by relocating it further in −x-direction (toward negative x-values). This way, it becomes impossible for material to leak out of air intake hole 107 when it is in upright orientation.

In the first embodiment, shell 101 is a one-piece part having mouthpiece hole 102, air intake hole 107, and view window 108. It also has other structures necessary to hold other parts and some parts of its interior walls are also used to form part of air path and part of aerosol path, and these path-forming structures will be discussed with discussion of other parts below. View window 108 may be an open structure or may be covered with a transparent or semi-transparent sheet.

In other embodiments, top side of shell 101 is open, and the mouthpiece is a separate part. Shell 101 may have a closed end at its bottom side. In such a case, mouthpiece may have structure of shell 101 above inside piece, may have locking mechanism to be locked with shell 101, and top seal 143 may be attached to mouthpiece before mouth piece is attached to shell 101 enclosing inside piece. In this embodiment, fillers do not need to insert inside piece into outside piece after material filling by themselves since everything except for mouthpiece and top seal 143 is pre-assembled. Prior to mouthpiece covering, fillers also need to seal the tank with top tank seal 110 when removable type is used but it would be unnecessary when self-sealing type is used. Thus, fillers complete assembly of portable aerosol device 100 by covering with mouthpiece. In such a case, locking mechanism which locks inside piece within shell 101 may be located near top part, near bottom, or both near top part and bottom part of shell 101 in order to restrict motion of inside piece in x-direction. This mechanism restricts user access to inside piece and provides user safety. Column 149 may not have column bottom lid 153 since bottom face of shell 101 can function as column bottom lid 153. Such closed bottom face of shell 101 may have bent hole in order to efficiently release excess heat from coil. With such closed bottom face of shell 101, column top lid 152 may be a separate part attached after other parts of inside piece is inserted into shell 101. Also, cover 135 and case lid 131 may not be necessary since such closed bottom face of shell 101 can seal air path and aerosol path at the bottom of column 149.

Because shell 101 has mouthpiece function, portable aerosol device 100 needs no separate mouthpiece. Thus, there is no parting line between shell 101 and mouthpiece. This allows more freedom for exterior designs for printing, stickers, emboss, and deboss. It may be plastic casted part so that many design patterns can be mass produced. Also, there is no way for a mouthpiece to be unexpectedly dislocated at any time. When shell 101 is made of transparent or semi-transparent plastic, structure of view window 108 can be negated. This way, the tank shell may be thinner since structural strength is higher without view window 108. This can reduce device size in y and z direction and reduce cost by needing less material.

Inner surface of shell 101 is parallel to the x-axis all around, and, as such, the y-z cross sectional area of shell 101 does not change near its bottom as y-z cross sectional view position is changed in x-direction in the first embodiment. This requires friction with outer surface of bottom cap 141 for it to be secured. In other embodiments, a locking mechanism that locks the inside piece within the shell 101 may be located near bottom part of shell 101 in order to restrict motion of inside piece in x-direction. This mechanism restricts user access to inside piece and provides user safety.

X-y cross sectional view of Top tank seal 110 is shown in FIG. 1C.

Top tank seal 110 is made of silicone, plastic, rubber, or metal. It is used to seal first end 118. Surface of top tank seal 110 that fits with inner surface of tank 111 may be slick and tightly fit with friction. In the first embodiment, top tank seal 110 also have structure to cover top surface of tank 111 to ensure the sealing. Although there is an empty space between top tank seal 110 and shell 101 in x-direction, this space can be filled with structure of shell 101, lengthened top tank seal 110, by positioning tank 111 higher along x-direction, by lengthening tank 111 along x-direction, or by inserting another space filling part. When this space is filled, top tank seal 110 can be pushed against shell 101 so that first end 118 can be sealed more tightly for better leakage prevention.

Top tank seal 110 may be attached to seal first end 118 after tank is filled with vaporizable material. This type of top tank seal 110 is an example of removable type. This way, viscous material can be inserted easily since opening of first end 118 is kept large during filling. In such a case, inside piece is inserted into outside piece after tank filling.

If top tank seal 110 is made of silicone or rubber, material can be injected by poking a hole by needle through top tank seal 110 after it is attached to tank 111 because the hole made by this poking will be closed after injection needle is removed. This type of top tank seal 110 is an example of self-sealing type. In such a case, injection can either be done before or after inside piece is inserted into outside piece. Injection is done after all assembly of portable aerosol device 100 is completed for later case. This makes process for fillers easier. For such a case, shell 101 can utilize a "shell injection hole" at a location higher than top surface of top tank seal 110 so that a straight injection needle can penetrate through top seal 110. For example, the shell 101 can include the shell injection hole in a first end of the shell 101 proximate the first end 118 of the tank 111, and the tank seal 110 can be a self-sealing silicone or rubber tank seal 110 such that the vaporization material can be injected with a needle through both the shell injection hole and the silicone or rubber tank seal.

In another embodiment, tank 111 has no opening at first end 118 and has an opening on sidewall called "side tank hole." Again, if silicone or rubber material is used to seal side tank hole, material injection can be done before or after side tank hole is sealed with "side tank sealer," and later case requires shell injection hole on sidewall of shell 101. For example, the shell 101 can include a shell injection hole proximate the sidewall of the tank 111, and the tank 111 can include a sidewall hole sealed with a self-sealing silicone or rubber sidewall seal such that the material can be injected with a needle through both the shell injection hole and the silicone or rubber sidewall seal. In such a case, view window 108 may serve as a shell injection hole. However, shell injection hole may also be located on sidewall of shell 101 other than viewing window 108, or the viewing window can be positioned on only one side of the shell. "Side injection" done in such a case makes possible to avoid inverted injection process. If injecting from first end 118 in the first embodiment with open first end 118, the injection syringe or at least injection needle can be inverted or nearly inverted in order to avoid leakage during injection. If not inverted, leakage occurs after material reaches second end 119 since further injection of material and/or air pushes material out through second end 119. Also, inverted injection is awkward for hand or manual injection operation because an operator or filler has to invert the injection device. Side injection allows the device orientation to be inverted but both syringe and needle can be nearly horizontal during tank filing. This is more natural and easy injection process. Also, in this embodiment with closed first end 118, LED space 109 may be extended to be "extended LED space" to cover all space between first end 118 and shell 101.

In an embodiment, the first end 118 of the tank 111 or the tank opening can be configured as a threaded female connector, and the tank seal 110 for sealing the tank can be configured as a threaded male connector. For example, a transparent plastic sealing screw is used to seal first end 118 so that light from LED light can enter through the transparent screw and directly illuminate material without having to go through tank sidewall while sealing first end 118 very tightly to avoid leakage. This is a "top-lighting system" instead of back-lighting system. Such a plastic screw needs a screwing shape typically of +, −, hexagonal, zigzag or other shape to screw in the plastic screw. This screwing shape should not intervene optical path. Thus, if it is + or − shape for example, it can be located a top peripheral part of plastic screw so that there is no interference of light. For example, a hexagonal shape can have flat surface in its center but needs 106 edges and 106 sides inside screw diameter so that it is less light and space efficient compare to above + or − shape example. In this embodiment, LED can be set inside extended LED space. Without optical element space 112 and flat LED light guide 113, the portable aerosol device 100 may be made smaller in y-direction.

Proprietary shape can be used for screwing structure instead of using typical shapes like +, −, or hexagonal shape in order to limit user's access to filing tank 111. Furthermore, such a screwing structure can be destroyed after filling is completed. This can also help avoid misuse by consumers since consumers cannot fill the tank by themselves.

When plastic screw is used to seal first end 118, such screw may have wider structure in y-z cross section above top face of tank 111 than structure of tank 111 so that it can sandwich a structure sticking out of column 149 in order to secure attachment of tank 111 to column 149. For example, structure similar to column top pins 150 can be sandwiched by such a plastic screw.

X-y cross sectional view of tank 111 is shown in FIG. 1C, where dotted lines indicate tank grooves 116.

Tank 111 is made of plastic material by plastic casting. Fully transparent plastic material for tank 111 allows users to view the material stored inside tank 111, and the fully transparent plastic material is effective use of LED back-lighting system, but it may also be semi-transparent. Part of inner and/or outer surfaces of tank sidewall can be textured, for example, with scratches or some other means to create a rough surface, to diffuse light from light source. Such scratches or rough surface treatment may replace diffuser for the back-lighting system. This would make assembly process easier. Also, patterned illumination can be realized with patterned scratches or patterned rough surface treatment for certain indications such as for material level in the tank 111, coil-firing indication, battery-level indication, or for decoration reasons. Battery level indication may be done by combination of particular light source color and matching fluorescent material inserted into grooves of scratches.

Tank 111 is attached to column 149 from right side. Body of tank 111 between its top surface and tank joint pin hole 115 is sandwiched by column top pins 150 and column center pin 151. Z-position of tank joint pin hole 115 is located at midway of tank 111 in z-direction. This can be understood by looking at FIG. 1G because it is matched with column center pin 151. Tank 111 has enough thickness for structure of tank joint pin hole 115 to be made because tank 111 has narrower interior volume toward second end 119.

Left side of optical element space 112 and right side of column body 165 forms a rectangular column gap extending in x-direction with an open end at the top. An optical element such as a diffuser can be inserted into optical element space 112 so that LED light can be deflected to illuminate tank 111 and material stored inside. Optionally, additional optical elements such as gratings, other light guide means, refractive index matching sheet, or fluorescent material may also be inserted in order to enhance the LED lighting system. For example, an outer, flat sidewall of the tank 111 opposite the viewing window 108 can be adjacent to one or more optical elements selected from a diffuser and a grating. Also, premade back-lighting system or premade lighting system can be inserted into optical element space 112.

Two parallel flat surfaces on tank 111, namely the inner sidewall and the outer sidewall of the tank 111 opposite the viewing window, can be flat and parallel to each other extending in the x-direction or longitudinal direction to form an optical guide or LED-light guide 113 for illuminating the tank, any of the material in the tank, or a combination thereof. Light generated from light source goes through LED-light guide 113. Inside LED-light guide 113, some light makes total internal reflection with its inner surfaces and some light is diffused by a diffuser and directed toward material and to view window 108. Thus, LED-light guide 113 is part of back-lighting system created during plastic casting process of tank 111. Light source is not limited to LED, but it may be organic LED (OLED) light source or others.

In another embodiment, top tank seal 110 may have refracting characteristics. It can be done by using a semi-transparent silicone cap or by transparent or semi-transparent plastic cap or screw. This way, LED light can enter into wall of tank 111 from all of top face of tank 111 to illuminate tank 111 and material stored inside from above. This is a top-lighting system. In this case, nearly entire side wall of tank 111 is considered to be LED-light guide 113, and part of tank except for the part that overlaps with view window 108 may be wrapped by a diffuser sheet to form more effective lighting system.

In the first embodiment, first end 118 is wide open or opened straight in x-direction so that die can be slid out during casting process. Exit hole 114 is located at second end 119 and sealed with exit hole seal 120 which holds wick 125. There are two tank grooves 116 on +z side (on positive side of z-values) and −z side (on negative side of z-values) of tank 111. Tank grooves 116 drawn with dotted lines in FIG. 1C run parallel to y-axis are guiding grooves for cover rails 137. Because tank 111 has narrower interior volume toward second end 119, tank 111 has enough wall thickness for tank grooves 116 without having to need more tank length in x-direction.

In the first embodiment, tank sidewall transitioning to exit hole 114 ("bottom edge") is made to smoothly and continuously transition as opposed to a sharp, angled transition, otherwise material will be deposited at a corner between the tank sidewall and the exit hole if the transition makes a sharp angle. Thus, the shape of the sidewall transitioning to the exit hole 114 can be made similar to an inverted bottle shape, a conical shape, or the like so that it makes a radius or an obtuse angle instead of near acute angle. This makes bottom edge of tank 111 to be a treated bottom edge. This way, material stored inside tank 111 can be fully consumed. Thus, bottom edge shape should take an obtuse angle having more than 90 degrees in between and made smooth. In the first embodiment, inner shape of tank 111 is not a complete cylindrical shape. It is a cut cylindrical shape cut with two flat surfaces of LED-light guide 113. Thus, y-z top view is not circular. This makes inner surface to have discontinuous or non-smooth shape. This is to achieve functionality of LED-light guide 113 to be more effective while minimizing the device size in y-direction. However, in order to create better full consumption condition of material stored inside tank 111, y-z cross sectional shape of tank 111 should also be smooth. Thus, y-z cross sectional shape of tank 111 is better to be near circular, elliptical, oval, etc.

In an embodiment, first end 118 is closed and may be configured to have extended LED space for the light source proximate the first end 118 of the tank 111. This allows light to go through other part of tank wall and/or top tank seal 110 when it is made transparent or semi-transparent. Illumination area may be less than or equal to y-z cross sectional area of tank inner volume or greater than y-z cross sectional area of tank inner volume. Further, illumination can be limited to go through only tank wall by using light source shape that matches y-z cross section shape of tank wall and/or by blocking light for inner area. In such embodiment, first end 118 may be closed by two flat surfaces parallel to y-z plane, by lens structure, and also may have scratches to work as light diffusing surface. Since tank is made with transparent or semi-transparent material, this allows easy top illumination. As discussed above, this would be a side injection embodiment, and it allows top illumination light source to be assembled before tank filling. To realize an embodiment with closed first end 118, second end 119 has to be wide open in order for die to slide out during casting production process of tank 111. The second end may still be connected by a part with treated bottom edge for full consumption of material. Illumination area may be less than or equal to y-z cross sectional area of tank inner volume or greater than y-z cross sectional area of tank inner volume. Further, illumination can be limited to go through only tank wall by using light source shape that matches y-z cross section shape of tank wall and/or by blocking light for inner area.

In an embodiment, tank 111 and column 149 are integral or made as one-piece part. In such an embodiment, top-lighting system may be applied. Then, optical element space 112 and LED-light guide 113 may be unnecessary. Also, structures to attach tank 111 to column 149 become unnecessary. Namely, tank joint pin hole 115, column top pins 150, and column center pin 151 become unnecessary. Therefore, portable aerosol device 100 may be smaller in y-direction, becomes more steady or stable, and assembly process will be less. In such an embodiment, interior shape of part of tank body to hold material can be a simple cylindrical shape with no edges. Such a smooth and continuous internal shape is favorable for full consumption of material since there is less chance for material deposit to occur. Also, shape of air path and aerosol path inside column 149 in y-z cross sectional view may be deformed from square shape in the first embodiment and make efficient use of extra or otherwise unclaimed space created by circular shape in y-z or transverse cross-sectional view of tank 111, battery unit 167, or both the tank 111 and the battery 167. When both battery unit 167 and tank 111 is made into cylindrical shape for example, two circles are seen from top view. In other words, the tank, the battery, or each one of the tank and the battery can be approximately circular in shape in accordance with a transverse cross-section thereof, and each path of the air and aerosol paths can be configured to use unclaimed space in the portable aerosol device adjacent to the tank, the battery, or each one of the tank and the battery. Then, shape of air path and aerosol path inside column 149 in y-z cross sectional view may take similar to triangular shape in order to efficiently make use of space. This will enable portable aerosol device 100 to be smaller in y-direction.

Tank 111 may have anti-reflection coating in order to make efficient use of light from light source. Anti-reflection coating can be put on its exterior surface such as curved surface of the outer sidewall facing view window 108, large flat surface facing column 149, and/or top surface of LED-light guide 113. It can be also put on the other top face of tank 111 for embodiment other than the first embodiment, can be put on the interior surface of tank 111, and/or can be put on top tank seal 110. It can be also put on one or both sides of transparent sheet cover on view window 108. The transparent sheet can include an anti-reflective-coated transparent sheet, a transparent sheet of an anti-reflective material, or an anti-reflective-coated transparent sheet of an anti-reflective material over the viewing window in order to make efficient use of light from internal light source. It can also be put on area of shell 101 surrounding (or in contact with) tank 111 when shell 101 is made of transparent plastic.

In addition, a portable aerosol device with the tank 111 can include a tank formed of a UV-protective material, coated with a UV-protective coating, or formed of the UV-protective material and coated with the UV-protective coating. The UV-protective coating, if present, can be on a sidewall of the tank 111 such as an outer sidewall of the tank 111.

UV protection coating can prevent the material deterioration from UV light exposure. A portable aerosol device should not contain UV light generator within itself which expose UV light to material. Thus, possible UV light source coming from outside of device such as from sunlight should be reduced or blocked before UV light reaches material. Therefore, UV protection coating may be applied to all area of external surface of tank structure where UV light from outside passes through before reaching the material. Also, same or similar protective effect can be achieved by UV protection coating on internal surface of material holding structure. Also, UV protection coating can be applied to both external and internal surfaces. In the first embodiment, at least the right side (exterior and/or interior surface) of tank 111 facing viewing window 108 may have UV protection coating. Also, UV protection coating can be applied on one or both sides of optional transparent sheet covering view window 108. It can also be put on area of shell 101 surrounding (or in contact with) tank 111 when shell 101 is made of transparent plastic.

To effect the UV protection, the shell 101 can alternatively or additionally include a UV-coated transparent sheet, a transparent sheet of a UV-blocking material, or a UV-coated transparent sheet of a UV-blocking material over the viewing window 108 to protect the material in the tank 111 from UV radiation.

In an embodiment where first end 118 is closed, second end of tank has to be wide open in order for die to slide out during casting production process of tank. The second end may still be connected by a part with treated bottom edge for full consumption of material. Side injection allows top illumination light source to be assembled before tank filling.

X-y cross sectional view of exit hole seal 120 is shown in FIG. 1C.

Exit hole seal 120 is made of silicone, plastic, or metal. Exit sealing column 122 tightly fits inside exit hole 114 or may be screwed into exit hole 114. Exit sealing step 123 fits inside case wall 134. Wick 125 tightly fits inside exit sealing hole 121 so to avoid leakage and motion of vaporizer unit 124.

X-y side view of vaporizer unit 124 is shown in FIG. 1C. Vaporizer unit 124 is composed of wick 125 and coil 126.

Wick 125 may be made of porous ceramic tube, porous ceramic rod, silica fiber, silica fiber or other non-burning fibrous material (e.g., fiber wick) inserted inside porous ceramic tube, or cotton inserted inside porous ceramic tube. Wick 125 fits tightly inside exit sealing hole 121 at its upper part and further held by wick hole 128 at its lower part. Coil 126 is located between the upper and lower part of wick 125. Its x-position is about midway of wick 125 inside case 127.

Wick 125 transfers or wicks material from tank 111 to coil 126 in order for the material to be heated to at least a vaporization temperature thereof and to form an aerosol inside case 127. Porosity of ceramics and density of fiber wicking material used for wick 125 have an influence on wicking speed and vaporized particle size. Thus, combination of wicking material, porosity of ceramics, and density of fiber wicking material should be optimized. For deep lung inhalation therapy, vapor particle size of about 1 to 5 microns is said to be especially effective. Thus, porous size of ceramics should be small in similar degree, but at the same time smaller porous size results in slower wicking speed. Thus, porous size of ceramics should be between about 0.1 and 100 microns such as between about 1 and 50 microns.

Also, because wick material has ability to hold certain amount of material within, it may prevent leakage by the following mechanism. When coil 126 is fired (voltage is applied across coil 126) and heated up, neighboring parts such as wick 125, case 127, tank 111, cover 138, and material are also warmed up in some degree, and then viscosity of material inside wick and tank may be lowered. After coil firing is ceased, viscosity of material starts to fall with these neighboring parts and material cooling down. During such cooling down process, material becomes less runny or more viscous in the system. In parallel to above warming up and cooling down process, saturation of wick with material also changes. This is determined by balance of wicking speed and vaporization rate of material. Vaporization unit 124 with certain applied voltage may be designed so that vaporization rate of material is faster than wicking speed. Then, as coil 126 is fired for longer period of time, wick 125 starts to get drier or less saturated. This condition creates more space for wick 125 to suck up and hold material within. Thus, it can prevent leakage by having such extra saturation space within wick 125 as viscosity of material lowers during the cooling down process after firing is ceased. If viscosity of material lowers too slowly or if saturation space within wick 125 is too little, material may be too runny and end up with oversaturation of wick 125, and, therefore, material also possibly leaks into case 127, aerosol path, and air path. Wicking material listed above and volume of wick 125 affect the saturation ability and ability to cool down. Ceramics typically take a longer time to cool down than fiber materials, and larger volume of wick 125 results in longer cooling time. Thus, while fixing porous size of ceramics to be optimum for vapor particle size, combining of ceramics with fiber material may have advantage of controlling such material holding volume and cooling down speed.

Coil 126 is made of metal wire, and material of metal wire may be Kanthal® (iron-chromium-aluminum [FeCrAl] alloys), titanium, stainless steel, Nichrome (alloys of nickel, chromium, and often iron), nickel, etc. Coil 126 generates appropriate heat when voltage is applied through it. Coil 126 is wrapped around wick 125 in the first embodiment. Thus, coil 126 vaporizes material as it is fired.

In an embodiment, coil 126 may be embedded or half embedded inside wick 125. In such case, wick may be porous ceramics with option of combining with fiber wick material as discussed above. Further, coil 126 can be replaced by other forms of heater such as flat heater, donut shape heater, cup shape heater, etc. with which material does not contact with heating metal material used.

X-position of coil 126 is fixed by friction with wick 125 as it is wrapped around it. Having the positive and negative coil wire passed through individual positive lead hole 132 and negative lead hole 133 respectively also helps holding x-position of coil 126 in place as well as holding it in right rotational orientation about local x-axis centered at center of wick 125.

X-y cross sectional view of case 127 is shown in FIG. 1C where case air inlet 129, case aerosol outlet 130, positive lead hole 132, and negative lead hole 133 are indicated with dotted lines.

Case 127 is made of silicone, plastic, ceramics, glass, or metal. Case 127 better holds heat from coil 126 within its enclosure when silicone or plastic material is used because of their heat insulation characteristics. In such a case, ramp-up time for coil 126 to reach an optimum vaporization temperature may be shorter than the case where higher heat conducting material such as metal is used. Users do not wait long time for aerosol to exit from mouthpiece hole 102 for inhalation. In addition, such heat insulation material can prevent transferring heat to device exterior surface so that users will not feel dangerous and anxious by sensing the excess heat from coil 126.

Case 127 seals vaporizer unit 124 below and around exit hole seal 120. Upper part of inner surface of case wall 134 fits outer part of exit seal step 123. Lower part of wick 125 fits tightly inside wick hole 128. Wick hole 128 is aligned with exit hole 114 and exit sealing hole 121 so that wick 125 is parallel to x-axis. Case air inlet 129 and case aerosol outlet 130 connects to column air outlet 158 and column aerosol inlet 159 respectively and seals air path and aerosol path between case 127 and column 149. As can be seen in FIG. 1G, relative location of case air inlet 129 and case aerosol outlet 130 are displaced in z-direction with case air inlet 129 being located on +z side. Yet, air path at bottom part of column 149 is still open so case lid 131 seals it to complete the connection and sealing. Position of case positive lead hole 132 and case negative lead hole 133 are above and below case air inlet 129 in the first embodiment since wires connected to coil 126 go through air path, but they can also be located above and below case aerosol outlet 130 or between case air inlet 129 and case aerosol outlet in z-direction.

FIGS. 1D-1F show development views of cover 135. The view shown in FIG. 1D is a top view, the view shown in FIG. 1E is an x-y side view, and the view shown in FIG. 1F is a bottom view from left. In x-y side view, long dotted line parallel to x-axis indicates boundary of semi-circular shape and flat shape of cover wall 136 when viewed in y-z plane, and other dotted line indicate cover rails 137. Out of four dotted lines in top view, inner two dotted line shows thickness of cover rails 137 bent 90 degrees in z-direction. Other two dotted lines indicate bending lines of cover rails 137.

Cover 135 is made of metal material for its strength and heat conductive characteristics, but it can also be made of plastics, glass, or ceramics. Metal material strength realizes small device while having high ability to secure above listed parts by having small thickness with high stiffness and elasticity. Metal's high heat conductive characteristic helps avoid overheating of case by spreading extra heat to certain area. Because most of cover 135's coverage is over case 127 and coverage over tank 111 is limited, it can prevent overheating of tank 111 in order to prevent damaging of material stored inside tank 111 by excess heat. Originally flat sheet of metal in x-z plane is cut, bent and/or pressed to make cover 135. Thus, bottom face division line 140 is the line of two cover bottom walls 139 meeting after bent or pressed. Thus, cover bottom walls 139 is physically divided with this line. However, since bottom face of column air outlet space 164 is sealed by case lid 131, air path is made airtight.

By covering part of tank 111, part of case 127, and part of column 149, cover 135 secures tank 111 and case 127 with column 149 and helps seal gaps between them. Referring to top view of FIG. 1E, a little more than upper half (toward +y-direction) of cover 135 encloses part of tank 111 and major part of case 127, and a little less than lower half of cover 135 covers case lid 131 and lower part of column 149 in x-y plane on both sides (both + and −z sides). As cover 135 is slid in −y (toward negative side of y-values) direction from the right side of tank 111, cover rails 137 is guided by tank grooves 116. When cover 135 is inserted all the way in, two cover position fixers 138 fit with column fixer steps 163 by a click, column side fitting steps 162 is covered, top part of cover wall 136 fits tank step 117, half cylindrical shape of cover wall 136 fits with half cylindrical shape of tank 111 and case 127. Cover 135 tightens tank 111, case 127, and column 149 essentially in all x, y, and z directions. Thus, air path and aerosol path except for the part formed with shell 101 and top tank seal 110 are sealed.

X-y side view of bottom cap 141 is shown in FIG. 1C where dotted lines indicate vent holes 142 in x-y cross section at midpoint in z-direction.

Bottom cap 141 is made of plastic, silicone, ceramics, glass, or metal. Plastic material is advantageous in that it has a low production cost and a degree of stiffness that can modified for production as desired.

In the first embodiment, bottom cap 141 is fit inside bottom end of shell 101 by friction to secure all parts inside shell 101. They fit together tightly so that users cannot take out bottom cap 141 easily and also so that inside piece does not come out of outside piece by accident unless users try very hard with some special tool. For this reason and for exterior design reason, bottom cap 141 should be completely contained inside shell 101 in x-y plane view. However, it is also possible for bottom cap 141 to have a bottom part sticking out from bottom end of shell 101 in +x-direction having same external size as shell 101 in y-z plane view to fix the depth of insertion with or without pressuring inside piece in −x-direction.

As mentioned above, in an embodiment, bottom cap 141 may also have matching clicking structures with shell 101 as to secure its position in x-direction. Such matching clicking structure may have slanted or curved structure so that bottom cap 141 applies pressure to inside piece in −x-direction. This pressure can be used to push cover bottom walls 139 and case lid 131 against bottom face of column 149 to seal air path, push top tank seal 110 against inner structure of shell 101 to seal first end 118, and push column 149 and top seal 143 against inner structure of shell 101 to seal aerosol path. When matching clicking structures are made to suppress any motion of bottom cap 141 in +x-direction after inserted, this helps preventing misuse of portable aerosol device 100 since users cannot take out inside piece to fill material by himself.

Bottom cap 141 may have multiple vent holes 142. Because bottom cap 141 is placed adjacent to cover 135, it allows heat from cover 135 transferred from coil 126 to be dissipated into external atmosphere efficiently in order to prevent overheating of shell 101 and bottom cap 141 for user safety and minimize user anxiety from sensing excess heat since users can directly touch shell 101 and bottom cap 141.

X-y side view of top seal 143 is shown in FIG. 1C where upper two dotted lines indicate top seal aerosol hole 145 and lower two dotted lines indicate top seal pin hole 144. Top seal aerosol hole 145 is a penetrating hole while top seal pin hole 144 is non-penetrating hole.

Top seal 143 is made of silicone, plastic, or metal. Top seal 143 fits into shell 101 from bottom. Top seal body 147 fits tightly inside main peripheral shell seal step 106, bottom face of right side end of top seal body 147 is pressed against bottom side of shell seal step 104 by top face of column 149. Shell pin 103 is inserted into top seal pin hole 144. Bottom surface of peripheral shell seal step 106 is covered by top seal lid 146. Shape of top seal aerosol hole 145 is fitted with shape of column aerosol outlet 155 to seal aerosol path connection.

Top seal 143 may optionally have a hole connecting to chip space 148 or have an extra hole on shell 101 directly connecting to outside to mix aerosol with more air to create thinner aerosol.

X-y side view of chip space 148 is shown in FIG. 1C.

Chip space 148 is space enclosed by column 149, top seal 143, and shell 101. It contains a PCB or other similar circuit board, an airflow sensor, and wires and also a part of air path connecting air intake hole 107 and column air inlet 154. The two wires from battery are connected to the circuit board inside chip space 148. The circuit board has two outgoing wires for LED light and two outgoing wires for coil 126.

FIG. 1G shows development view and one cross sectional view (A-A) of column 149. Center side view is x-y side view as indicated with x-y coordinate symbol.

Column 149 is made of plastic, silicone, rubber, glass, ceramics, metal, or a combination thereof. It can be manufactured by injection casting for low production cost since it has many structures. Plastic is used for its low material and manufacturing cost and its hardness. Transparent or semi-transparent plastic may be used since it helps assembly process since wires can be viewed from outside when they are put through its air path and for design reasons. Also, users may be able to view aerosol traveling inside aerosol path during user operation in an embodiment where shell 101 is also made of see through material.

As discussed above, column top pins 150 and column center pin 151 are used to bind column 149 with tank 111.

LED light element may be fitted tightly between two arms of main top pins 150, and end of LED light element additionally may be inserted into top part of optical element space 112 for tighter fit and to fix its position in z-direction. Top surface of column top lid 152 is part of enclosure of chip space 148. Battery unit 167 fits between column top lid 152 and column bottom lid 153. Top wire groove 156 is a wiring path to LED space. Main top wire hole 157 allows wires from battery to enter chip space 148. Optional column bottom lid hole 160 is used to fix battery unit in position. Optional center wire groove 161 is wire path from bottom of battery unit 167 so that shape of battery unit 167 can match with curved shape seen in A-A cross sectional view in order to avoid battery shaking after assembly. Column side fitting step 162 and column fixer steps 163 fits with cover 135 as discussed above.

A straight air path inside column 149 parallel to x-axis starts from column air inlet 154 which is open in x-direction at the top and ends at column air outlet 158 which is also open in x-direction. This way, assembly workers simply can insert wires in +x-direction from top and the wires easily come out from the other side since wire from circuit board is connected to coil 126 through this air path. Positive and negative coil wires are connected with respective wires from circuit board by two metal clips (one for each connection). Part of these wires outside of case 127 enclosure may all be covered with electrical insulating material. Junctions made with the two metal clips can also be additionally covered by sliding insulator tubes over the two clips (two wires need to pass though these insulator tubes before wire connection is performed). However, these insulator tubes may not be used if the two connections are insulated by space by positioning them away from each other. Connection clips or parts that have electrical insulation characteristics (plastic clips for example) can be used.

Extra wire length and connection parts (two metal clips and insulator tubes) can be stored inside column air outlet space 164 in order to avoid unnecessary airflow restriction by occupying part of air path clearance. Part of wire can also be pulled back into chip space 148 for the same reason.

L-shaped aerosol path inside column 149 starts from aerosol inlet 159, which is open in y-direction, gets bent in x-direction inside, run parallel to x-axis to the top of column 49, and ends at column aerosol outlet 155 which is open in x-direction. Thus, aerosol path bends 90 degrees from y-direction to x-direction after aerosol enters column 149 from column aerosol inlet 159. However, this bending has no influence on wiring procedure since there is no wire passing through aerosol path of column 149. Aerosol path inside column 149 can have a cross sectional area greater than 1 $mm^2$, including greater than 1.5 $mm^2$, such as greater than 2.5 $mm^2$, for example, greater than 3.0 $mm^2$ in order to avoid gargling.

In another embodiment, air path of column 149 is bent in the similar way as aerosol path is bent (e.g., 'L' shape). In such an embodiment, bottom side of column air outlet space 164 is closed and the column air outlet 158 faces right side (+y-direction) parallel to column aerosol inlet 159. This embodiment has advantage since bottom face of column 149 does not need to be sealed by another part such as case lid 131 which is further covered by cover bottom walls 139. Then, case lid 131 and part cover bottom walls 139 (part underneath column 149) are made unnecessary. This can save material cost, makes assembly process simpler, and reduces device size in x-direction. In such an embodiment, two wires for coil can be pinched out by tweezers at the outlet end, or leading ends can be bent about 90 degrees so that they can stick out from column air outlet 158 when inserted all the way to the bottom.

In another embodiment, both air path and aerosol path of column 149 to make no bending and simply a straight path parallel to x-axis. In such an embodiment, case 127 possibly with additional parts seals and bends the two paths from y-direction into x-direction at the bottom area of column 149.

Aerosol path of portable aerosol device 100 makes double L-shape or twice forms the 'L' shape inside the portable aerosol device 100. This prevents spit back. Also, because L-shape bending is made in x-y plane, thickness of portable aerosol device 100 in z-direction is kept small.

More than 50% of the entire air path length and aerosol path length can be located inside column 149. As such, more than 50% of a length of each path of the air and aerosol paths can be located inside the space between the tank and the battery when the cartridge is inserted into the shell. This allows portable aerosol device 100 to be slim and compact in z-direction.

X-y side view of battery unit 167 is shown in FIG. 1C.

Battery unit 167 may be bulk battery, battery inside a battery case, or battery with attachment parts. Battery unit 167 fits between column top lid 152 and column bottom lid 153. Negative end or positive end of battery is oriented to face bottom. Wire from bottom side of battery unit 167 may be fitted into optional center wire groove 161. Two wires from positive and negative end of battery go through top lid wire hole 157. Battery unit 167 optionally has a pin like structure at its bottom side and it is fitted into bottom lid hole 160 to secure its position relative to column 149. Positive and negative wires going through top lid wire hole 157 also help secure the position of battery unit 167. Top lid wire hole 157 may be sealed after the two wires are passed through with sealer like silicone sealer to keep chip space 148 sealed.

When inside piece or cartridge is inserted into the shell 101 or the outside piece containing the shell 101, there may be a particular area(s) where these two parts fit tightly with friction in order to prevent from going apart. Alternatively, or additionally, the shell can include a locking mechanism configured to i) lock the cartridge in the shell upon inserting the cartridge into the shell and ii) restrict longitudinal motion of the cartridge in the shell. Regarding the friction or interference fit, let us define this area that causes friction between inside piece and outside piece as "first friction area." In the first embodiment, first friction area is located at the level of column top lid 152 (meaning x position is at column top lid 152) because air path between air intake hole 107 and column air inlet 154 can be sealed this way. It means that this way, chip space 148 has only air inlet at air intake hole 107 and air outlet at column air inlet 154 to attain consistent airflow for airflow sensor. Thus, at least some fraction of width in x-direction of column top lid 152 is used as first friction area. However, it is not an absolute necessity to locate first friction area at the level of column top lid 152 because aerosol path is airtight with silicone parts (case 127 and top seal 143) in the first embodiment. At the least, as long as there is enough airflow for airflow sensor to sense, sealing of chip space 148 can be imperfect and the portable aerosol device 100 can still functions. Thus, other parts of inside piece such as column bottom lid 153, column body 165, tank 111, and cover 135 may also have first friction area. Thus, there can be multiple first friction areas.

In order to realize first friction area with column top lid 152 for example, y-z cross sectional size of shell 101 below and above column top lid 152 can be made relatively larger than that of inside piece so that friction only occur at the level of column top lid 152 when inside piece is inserted all the way in. This way, it is easier to insert inside piece. At the same time, y-z cross sectional size of column top lid 152 is slightly made larger than that of shell 101 in order to cause friction. The size difference should be roughly between 10 and 50 micrometers and may be applied in y-direction, z-direction, or both y-direction and z-direction.

First friction area can also be achieved and/or supported by extra piece such as O-ring or band wrapped around inside piece or fit inside outside piece. By using such a part, clicking structure is also possible at deeper in −x-direction inside shell 101. However, without such a part, clicking structure is only possible near bottom of shell 101 as discussed above.

Operation of portable aerosol device is discussed below. As a user suck from mouthpiece hole 102, outside air enters from air intake hole 107 and goes into chip space 148. Because there is an airflow sensor inside chip space 148, user activates portable aerosol device 100 by the sucking action. When portable aerosol device 100 is activated, coil 126 is fired and LED light source may be lit up. Portable aerosol device 100 may also have other switching means such as button, touch sensor, or gravity sensor to activate coil 126 and LED light source. After entering from air intake hole 107, flow of air bends from traveling in +y-direction to traveling in +x-direction as air goes into column air inlet 154. Air further goes all the way to the bottom of column 149 traveling in +x-direction through its air path and exit from column air outlet 158. Inside column air outlet space 164, flow of air again changes direction into +y-direction. Then, air passes through case air inlet 129 and gets mixed with vaporized material to form aerosol inside case 127. This aerosol exits case 127 from case aerosol outlet 130 traveling in −y-direction which is connected to column aerosol inlet 159. The aerosol path bends from −y-direction to −x-direction inside aerosol path of column 149 making aerosol to go up through this path to the top of column 149 and exit from column aerosol outlet 155. Top seal aerosol hole 145 is coupled with column aerosol outlet 155 so that aerosol goes through top seal 143. Aerosol path is then bend into −y-direction inside the gap between topside of top seal 143 and shell 101. Inside this gap, there is shell pin 103. Thus, aerosol goes around shell pin 103, then gets bent into −x-direction and goes out from mouthpiece hole 102 for inhalation.

Second Embodiment of the Portable Aerosol Device and Methods Thereof

FIG. 2A provides a parts-based view of a portable aerosol device 200 in accordance with some embodiments. FIG. 2B provides a cross-sectional view of the portable aerosol device 200 in accordance with some embodiments. In the following description, references made to coordinates, axes, directions, and the like utilize the right-handed Cartesian coordinate systems shown in FIGS. 2A and 2B unless context indicates otherwise. In addition, "top" means −x-direction, "bottom" means +x-direction, "left" means −y-direction, and "right" means +y-direction.

TABLE 2

Parts list for the portable aerosol device 200 of FIGS. 2A and 2B.

| Part Number | Part Name |
|---|---|
| 200 | Portable aerosol device |
| 201 | Shell |
| 202 | Sealing ring |
| 203 | Tank cap |
| 204 | Tank |
| 205 | Vertical wick |
| 206 | Bottom tank seal |
| 207 | Heating unit (heating coil wrapped around a horizontal wick) |
| 208 | Metal case |
| 209 | Top silicone ring |
| 210 | Bottom silicone ring |
| 211 | Sensor casing |
| 212 | Light guide |
| 213 | Sensor unit (PBC, airflow sensor, LED light) |
| 214 | Bottom cap |
| 215 | Battery |

As shown in FIG. 2A, the shell 201 can be plastic, metal, or silicone. It has a mouthpiece hole at the top. After a cartridge including the sealing ring 202 through the sensor unit 213 and the battery 215 is inserted from an insertion opening at the bottom, the light guide 212 is inserted in the −y-direction and the bottom cap 214 is used to cover the insertion opening from the bottom. After material is injected from a material injection hole located at a top of the tank 204 while the portable aerosol device 200 is kept upright, the tank cap 203 is used to seal the material.

The sealing ring 202 can be silicone. The sealing ring 202 seals the gap between the shell 201 and the tank 204 about the x-axis at the top of tank 204.

The tank cap 203 can be silicone or plastic. The tank cap 203 seals the tank 204 after filling the material. It has a locking structure about its local x-axis near the bottom to prevent the tank cap 203 from falling off after capping. Pressure, ultrasound, or a screw is used for the tank cap 203 in order to avoid leakage.

The tank 204 can be made of plastic. The tank 204 includes a material injection hole. A first end of tank 204 is sealed by the tank cap 203, and a second end of the tank 204 is sealed by the bottom tank seal 206. Space below the bottom tank seal 206 is configured for vaporization of the material, and space to a left of the tank 204 is a portion of the vapor path.

The wick 205 is a vertical wick that can be made of silica fibers. The vertical wick 205 can be put through a wick hole of the bottom tank seal 206. The wick 205 wicks material from the tank 204 to the heating coil of the heating unit 207.

The bottom tank seal 206 can be made of plastic. The bottom tank seal 206 seals the tank bottom, and the bottom tank seal has a wick hole.

The heating unit 207 includes the heating coil wrapped around a horizontal wick. The heating coil is made of a metal material, and the horizontal wick is made of silica fibers or ceramics.

The horizontal wick is roughly parallel to the y-axis such that the horizontal wick holds the heating coil in position, as well as material within.

The metal case 208 is configured to fix the position of the heating unit 207 relative to the tank 204. The metal case also holds the sensor casing 211.

The top silicone ring 210 is configured to fix the position of the heating unit 207 in the x-direction.

The bottom silicone ring 209 is configured to keep two wires (e.g., the – and + leads) in position and provide electrical insulation.

The sensor casing 211 is configured to hold the sensor unit 213 in position relative to the tank 204. The sensor casing 211 prevents vertical movement of the tank 204 relative to the shell 201 by creating friction with the shell 201. The light guide 212 also limits movement in +x-direction. It provides two openings to the airflow path so that an airflow sensor in the sensor unit 213 can properly work.

The light guide 212 can be made of plastic. The light guide 212 guides LED-provided light emitted from the sensor unit 213 to outside of the portable aerosol device 200. The light guide 212 has a light diffusing structure.

The sensor unit 213 includes PBC, an airflow sensor, and one or more LED lights. The sensor unit 213 electronically controls the portable aerosol device 200 such as on and off states of the heating unit 207 and the one or more LED lights.

The bottom cap 214 is configured to seal an inside piece or the cartridge within the shell 201. The bottom cap 214 has air intake hole(s) at the bottom. The bottom cap 214 can be attached to the shell 201 by friction, glue, or a locking mechanism.

The battery 215 provides electrical power to the sensor unit 213 and heating coil of the heating unit 207.

As shown in FIG. 2B, as a user draws from the mouthpiece hole of the shell 201, air enters from air intake hole(s) at the bottom of portable aerosol device 200 at point 221. An airflow line is shown connecting from the point 221 to point 222 between the tank 204 and the battery 215 laterally (in the y-direction) and at an angle. It should be understood that the exact angle and location of the airflow may be varied without exceeding beyond the scope and spirit of the disclosure. For example, air may enter from location A (e.g., insertion opening). Here, there is at least one hole on the bottom cap 214, or there is at least one gap between the bottom cap 214 and the shell 201 to allow air into the portable aerosol device 200. Also, air can enter from location B (e.g., light guide hole) or location C (e.g., gap between tank and shell). In any case (e.g., A, B, C, or a combination thereof), air enters from outside and flows through the point 222.

After air goes through the point 222, it reaches point 223. At a same time, air at point 227 is pulled toward the point 223. This makes the airflow sensor of the sensor unit 213 turn on the heating unit 207. Then, air goes around the heating unit 207 and gets mixed with vaporized material to form an aerosol. The aerosol enters the vapor path of the tank 204 at point 224 and goes out at point 225. Aerosol finally exits the portable aerosol device at point 226 where it gets inhaled by the user.

Third Embodiment of the Portable Aerosol Device and Methods Thereof

FIG. 3A provides a parts-based view of a portable aerosol device 300 in accordance with some embodiments. FIG. 3B provides a cross-sectional view of the portable aerosol device 300 in accordance with some embodiments. In the following description, references made to coordinates, axes, directions, and the like utilize the right-handed Cartesian coordinate systems shown in FIGS. 3A and 3B unless context indicates otherwise. In addition, "top" means –x-direction, "bottom" means +x-direction, "left" means –y-direction, and "right" means +y-direction.

TABLE 3

Parts list for the portable aerosol device 300 of FIGS. 3A and 3B.

| Part Number | Part Name |
|---|---|
| 300 | Portable aerosol device |
| 301 | Shell |
| 302 | Sealing ring |
| 303 | Tank cap |
| 304 | Tank |
| 305 | Coil casing |
| 306 | Metal case |
| 307 | Heating unit (heating coil is partially or fully embedded near inner cylindrical surface of ceramic tube) |
| 308 | Sensor casing |
| 309 | LED light guide |
| 310 | Sensor unit (PBC, Airflow sensor, LED light) |
| 311 | Bottom cap |
| 312 | Battery |

As shown in FIG. 2A, the shell 301 can be plastic, metal, or silicone. It has a mouthpiece hole at the top. After a cartridge including the sealing ring 302 through the sensor unit 310 and the battery 312 is inserted from an insertion opening at the bottom, the light guide 309 is inserted in the –y-direction and the bottom cap 311 is used to cover the insertion opening from the bottom. After material is injected from a material injection hole located at a top of the tank 304 while the portable aerosol device 300 is kept upright, the tank cap 303 is used to seal the material.

The sealing ring 302 can be silicone. The sealing ring 302 seals the gap between the shell 301 and the tank 304 about the x-axis at the top of tank 304.

The tank cap 303 can be silicone or plastic. The tank cap 303 seals the tank 304 after filling the material. It has a locking structure about its local x-axis near the bottom to prevent the tank cap 303 from falling off after capping. Pressure, ultrasound, or a screw is used for the tank cap 303 in order to avoid leakage.

The tank 304 can be made of plastic. The tank 304 includes a material injection hole. A first end of tank 304 is sealed by the tank cap 303, and a second end of the tank 304 is sealed by the bottom coil casing 305. Vaporization takes place inside the heating unit 307, and space to a left of the tank 304 is a portion of the vapor path.

The coil casing 305 can be made of silicone. A coil casing 305 seals the second opening of the tank 304, provides wicking holes to the heating unit 307, and holds the heating unit 307. A circle drawn with a dotted line on heating coil unit 307 indicates the x-y position of the wick holes on the coil casing 305. In this embodiment, the wick holes 305 are made in the z-direction. However, the hole direction can be located at different points by rotating it about an axis of a cylinder of heating unit 307. The top surface of the coil casing 305 is angled relative to the YZ plane or has a curved shape so that material runs down to one or more wick hole with gravity when the aerosol device 300 is in an upright position.

The metal case 306 is configured to fix the position of the heating unit 307 relative to the tank 304. The metal case also holds the sensor casing 308.

The heating unit 307 includes a wicking part that can be made of ceramic (i.e., a ceramic wick) and a heating coil that can be made of metal. The ceramic wick is a hollow cylindrical structure, and the heating coil is partially or fully embedded near an inner surface of the hollow cylindrical structure. The ceramic hollow cylinder can be wrapped around by fibers inside the coil casing 305 in order to adjust wicking characteristics.

The sensor casing 308 is configured to hold the sensor unit 310 in position relative to the tank 304. The sensor casing 308 prevents vertical movement of the tank 304 relative to the shell 301 by creating friction with the shell 301. The light guide 309 also limits movement in +x-direction. It provides two openings to for the airflow path so that an airflow sensor in the sensor unit 310 can properly work.

The light guide 309 can be made of plastic. The light guide 309 guides LED-provided light emitted from the sensor unit 310 to outside of the portable aerosol device 300. The light guide 309 has a light diffusing structure.

The sensor unit 310 includes PBC, an airflow sensor, and one or more LED lights. The sensor unit 310 electronically controls the portable aerosol device 300 such as on and off states of the heating unit 307 and the one or more LED lights.

The bottom cap 311 is configured to seal an inside piece or the cartridge within the shell 301. The bottom cap 314 has air intake hole(s) at the bottom. The bottom cap 311 can be attached to the shell 301 by friction, glue, or a locking mechanism.

The battery 312 provides electrical power to the sensor unit 310 and heating coil of the heating unit 307.

As shown in FIG. 3B, as a user draws from the mouthpiece hole at point 326, air enters from one or more air intake holes at the bottom of portable aerosol device 300 at point 321. An airflow line is shown connecting from the point 321 to point 322 between the tank 304 and the battery 312 laterally (in the y-direction) and at an angle. It should be understood that the exact angle and location of the airflow may be varied without exceeding beyond the scope and spirit of the disclosure. Air enters from location A (e.g., insertion opening). Here, there is at least one hole on the bottom cap 311, or there is at least one gap between the bottom cap 311 and the shell 301 to allow air into the portable aerosol device 300. Also, air can enter from location B (e.g., light guide hole) or location C (e.g., gap between tank and shell). In any case (e.g., A, B, C, or a combination thereof), air enters from outside and goes through the point 322.

After air goes through the point 322, it reaches point 323. At a same time, air at point 327 is pulled toward the point 323. This makes the airflow sensor of the sensor unit 310 turn on the heating unit 307. Then, air goes through the hollow cylindrical structure of the heating unit 307 and gets mixed with vaporized material to form an aerosol. The aerosol enters the vapor path of the tank 304 at point 324 and goes out at point 325. Aerosol finally exits the portable aerosol device at point 326 where it gets inhaled by the user.

Advantages of the portable aerosol devices provided herein include one or more of the following: i) Full consumption of material stored inside tank, as desired; ii) leak-free system; iii) superior view of material stored inside the tank during usage and for determining full consumption; iv) inexpensive, durable, and compact; v) no dislocation of mouthpiece; vi) limited access to re-filling the tank in some embodiments to protect users from filling with material not designed for the device; vii) fast wicking speed; viii) easy pre-filling; ix) easy material injection for re-filling the tank in some embodiments; x) protection of material from UV light exposure; and xi) exterior design freedom.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. A portable aerosol device, comprising:

a) a mouthpiece;

b) a cartridge comprising a tank configured to hold a vaporizable material, the tank comprising a first end, a second end, and a sidewall between the first and second ends;

an atomization means for vaporizing the material, the atomization means comprising a wick configured to wick the material from the tank to a heating element configured to heat wicked material to at least a vaporization temperature thereof and provide an aerosol of the wicked material;

a battery configured to supply electricity to the heating element and a light source;

an air path fluidly connecting the atomization means to a source of external air for the atomization means; and an aerosol path fluidly connecting the atomization means to the mouthpiece configured to provide the aerosol to a user of the portable aerosol device, wherein each path of the air and aerosol paths is at least partially positioned in a space between the tank and the battery, wherein both the air path and the aerosol path form an 'L' shape using at least part of unclaimed space in the portable aerosol device adjacent to the tank and the battery; and c) a shell comprising an air intake hole, a viewing window, an opened or closed end, and an insertion opening configured for inserting the cartridge into the shell.

2. The portable aerosol device of claim 1, further comprising:

a cover configured to cover the cartridge upon inserting the cartridge into the shell.

3. The portable aerosol device of claim 1, further comprising:

a column integral with the tank disposed in the cartridge between the tank and the battery, the column including at least a portion of the air and aerosol paths.

4. The portable aerosol device of claim 1, wherein at least one of the air path and the aerosol path twice forms an 'L' shape using at least part of the unclaimed space in the portable aerosol device adjacent to the tank and the battery.

5. The portable aerosol device of claim 1, further comprising:

a light source configured to illuminate the tank, the material in the tank, or a combination thereof.

6. The portable aerosol device of claim 5, wherein at least a portion of the sidewall of the tank is configured as an optical guide for illuminating the tank, any of the material in the tank, or a combination thereof.

7. The portable aerosol device of claim 6, wherein an inner sidewall and an outer sidewall of the tank opposite the viewing window are flat and parallel to each other providing the optical guide, inside which light from the light source makes a total internal reflection.

8. The portable aerosol device of claim 7, wherein at least a portion of the outer sidewall of the tank is a textured surface configured to act as a diffuser.

9. The portable aerosol device of claim 8, wherein the textured surface includes one or more patterns for material-level indication in the tank, indication of the heating element being turned on, decoration, or a combination thereof.

10. The portable aerosol device of claim 1, wherein the wick is a fiber wick inserted in a porous ceramic-wick tube.

11. The portable aerosol device of claim 1, wherein the wick is a porous ceramic wick, and the heating element is a coil at least partially embedded in an outer surface of the wick.

12. The portable aerosol device of claim 1, wherein the shell includes a shell injection hole in a first end of the shell proximate the first end of the tank, the shell injection hole including a self-sealing silicone or rubber tank seal such that the material can be injected with a needle that is not part of the portable aerosol device through both the shell injection hole and the silicone or rubber tank seal.

13. The portable aerosol device of claim 1, wherein the viewing window is positioned on only one side of the shell.

14. The portable aerosol device of claim 5, wherein the light source is positioned in the portable aerosol device proximate the first end of the tank.

15. The portable aerosol device of claim 5, wherein the light source is positioned to project at least some light though the sidewall of the tank.

16. The portable aerosol device of claim 5, wherein the light source is positioned to project at least some light through the first end of the tank.

17. The portable aerosol device of claim 1, wherein the shell has a smooth outer surface, and one end of the shell is closed with the mouthpiece.

18. The portable aerosol device of claim 17, wherein a bottom face of the shell is the one end of the shell that is closed.

19. The portable aerosol device of claim 1, wherein the tank includes an inner sidewall and an outer sidewall between the first and second ends of the tank, and a smooth transition from the inner sidewall to an exit hole in the second end of tank.

20. The portable aerosol device of claim 5, wherein at least part of the tank, a tank seal, the shell, or a transparent sheet cover on the view window includes an anti-reflective coating or is comprised of an anti-reflective material.

21. The portable aerosol device of claim 1, wherein the atomization means is positioned at a bottom end of the shell, and wherein the atomization means is positioned beneath the tank.

22. The portable aerosol device of claim 1, wherein the mouthpiece is integrated with the shell and is a defined feature of the shell.

23. The portable aerosol device of claim 11, wherein the coil is at least partially embedded in the outer surface of the wick midway of the wick between an upper and lower part of the wick.

24. The portable aerosol device of claim 22, wherein at least part of the mouthpiece integrated with the shell is aligned with the aerosol path positioned between the tank and the battery.

25. The portable aerosol device of claim 1, wherein greater than 50% of the aerosol path is positioned between the tank and the battery in a space positioned lateral to the tank.

* * * * *